US005401122A

United States Patent [19]

Pate, Jr.

[11] Patent Number: 5,401,122

[45] Date of Patent: Mar. 28, 1995

[54] EXCAVATION SHIELD APPARATUS AND METHOD

[75] Inventor: Charles H. Pate, Jr., Norcross, Ga.

[73] Assignee: Gwinnett Enterprises, Limited, Norcross, Ga.

[21] Appl. No.: 55,983

[22] Filed: Apr. 29, 1993

[51] Int. Cl.[6] ..... E21D 5/00; E02D 17/08

[52] U.S. Cl. ..... 405/282; 405/272; 405/133; 405/249

[58] Field of Search ..... 405/282, 283, 249, 8–11, 405/133

[56] References Cited

U.S. PATENT DOCUMENTS

| | | | |
|---|---|---|---|
| 1,071,985 | 9/1913 | Conkling | 405/249 |
| 1,351,895 | 9/1920 | Dillon . | |
| 1,819,426 | 8/1931 | Ladd . | |
| 1,894,206 | 1/1933 | Talbot | 405/249 X |
| 2,010,293 | 8/1935 | Carswell et al. . | |
| 2,536,758 | 1/1951 | Macleod | 138/70 |
| 2,659,210 | 11/1953 | Stengel et al. | 405/282 |
| 2,750,749 | 6/1956 | Brown et al. . | |
| 3,304,954 | 2/1967 | Kaiser | 138/112 |
| 4,047,388 | 9/1977 | Howlett . | |
| 4,141,666 | 2/1979 | DeGraff | 405/126 |
| 4,310,267 | 1/1982 | Davis | 405/283 |
| 4,388,021 | 6/1983 | Weiss | 405/133 X |
| 4,397,583 | 8/1983 | Horncy et al. | 405/150 |
| 4,451,172 | 5/1984 | Lamphier et al. | 405/49 |
| 4,685,837 | 8/1987 | Cicanese | 405/282 |

FOREIGN PATENT DOCUMENTS

| | | | |
|---|---|---|---|
| 0094528 | 6/1983 | Japan | 405/282 |

OTHER PUBLICATIONS

Manguard TM Standard Features Flier, 1993.

*Primary Examiner*—Dennis L. Taylor
*Attorney, Agent, or Firm*—Hopkins & Thomas

[57] ABSTRACT

An excavation shield apparatus (10) and method prevent the collapse, or cave-in, of soil about a hole in the ground having one or more utility apparatus. The excavation shield apparatus (10) comprises a longitudinal body (11) having a lateral perimeter wall (12) surrounding a longitudinal throughway (13) adapted to be placed substantially vertically within the hole. A bottom end (11*a*) of the longitudinal body (11) is placed below the ground level and a top end (11*b*) is placed in close proximity to the ground level. The longitudinal throughway (13) is of sufficient size to permit passage of a person therethrough and has sufficient strength to endure forces imposed by the surrounding soil without substantial deformation. One or more apertures (16*a*–16*d*) are situated in the lateral perimeter wall (12) approximately at the bottom end (11*a*) for receiving utility apparatus therethrough so that a worker can operate upon the utility apparatus within the longitudinal throughway (13).

26 Claims, 3 Drawing Sheets

EXCAVATION SHIELD APPARATUS AND METHOD

FIELD OF THE INVENTION

The present invention generally relates to safety devices and, more particularly, to an excavation shield apparatus and method for protecting a worker from a collapse, or cave-in, of soil within a hole in the ground having a utility apparatus.

BACKGROUND OF THE INVENTION

Government regulations require utility companies to implement sufficient procedures to safeguard employees working underground on utility apparatus, for example, sewer, telephone, television, fuel, electric, or water lines, or some other utility apparatus requiring excavation of a hole for access thereto. In this regard, see 29 C.F.R. § 1926.650 et seq. (Occupational Health and Safety Administration, Labor). Generally, underground work on utility apparatus may be required when a utility apparatus is damaged in some way or when one utility apparatus is to be connected to another, for example, in the case where a main sewer line of a residential home is to be connected to a city sewer line in the street.

During the procedure, a primary concern is the collapse, or cave-in, of surrounding soil upon a worker while the worker is in the excavated hole. When the hole is excavated, the foregoing government regulations require a particular slope configuration, ranging from 34° to 53° from the horizontal., depending upon the soil composition surrounding the hole, and as the hole depth increases, a step configuration, often called a "benched excavation," is required in the slope configuration. Support or shield systems are also suggested in combination with some slope configurations. Generally, these support and shield systems include support structures and/or shores made of wood and/or steel beams.

However, the requisite safeguards in the industry as described above are very time consuming, labor intensive, oftentimes expensive, and impractical in many situations where the ground surface is cluttered with other structures or apparatus which cannot be readily moved or removed. Examples of immovable structures include a street, tree, or telephone pole. To make matters worse, the easement of the utility company is usually very limited so that excavation beyond certain limits is prohibited.

Thus, a heretofore unaddressed need exists in the industry for a novel process of permitting easy, inexpensive, and well protected access to an underground utility apparatus by a worker which does not suffer from the disadvantages and inadequacies of the prior art.

SUMMARY OF THE INVENTION

Briefly described, the present invention is an excavation shield apparatus and method for preventing the collapse of soil about a hole in the ground having a utility apparatus. The excavation shield apparatus comprises a longitudinal body having a lateral perimeter wall surrounding a longitudinal throughway and having a bottom end and a top end. The longitudinal body is adapted to be placed substantially vertically within the hole so that the bottom end resides below the ground level and so that the top end resides in close proximity to the ground level. The longitudinal throughway is of sufficient size to permit passage of a person therethrough. Moreover, the longitudinal body has sufficient strength to endure forces imposed by the soil without substantial deformation. Finally, at least one aperture is situated in the lateral perimeter wall approximately at the bottom end for receiving the utility apparatus therethrough. It is apparent from the foregoing configuration that upon placement of the excavation shield apparatus within the hole, the person may travel through the longitudinal body along the longitudinal throughway to access the utility apparatus while being protected from the collapse of the soil by the longitudinal body.

In a preferred embodiment of the present invention, the longitudinal body is formed from a plurality of cylindrical sections which are adapted to be connected together to form an elongated cylindrical body. This feature enables easy assembly and disassembly of the device for transportation and storage purposes and for repeated use.

Another feature of the preferred embodiment is a plurality of apertures situated approximately at the bottom end of the excavation shield apparatus. Preferably, a pair of apertures is misaligned. These apertures permit connections of a plurality of misaligned utility apparatus despite immovable obstructions, for example, a tree, telephone pole, cement pillar, or the like.

Another feature of the preferred embodiment is a flange which is situated at the top end of the longitudinal body. The flange projects outwardly from the longitudinal body and provides a supporting platform for a person entering or leaving the longitudinal body. The flange serves as a bridge over the gap between the longitudinal body and the hole perimeter.

Thus, a primary object of the present invention is to overcome the problems, deficiencies, disadvantages of the prior art as noted above in the background section of this document.

Another object of the present invention is to provide an excavation shield apparatus and method for preventing the collapse of soil about a hole in the ground having a utility apparatus.

Another object of the present invention is to provide an excavation shield apparatus and method which are inexpensive and easy to implement, while providing sufficient safeguards against collapse of soil upon a utility worker.

Another object of the present invention is to provide a durable excavation shield apparatus which can be assembled and disassembled for efficient storage, transportation, and repeated use.

Another object of the present invention is to provide an excavation shield which is simple in design and reliable in operation.

Another object of the present invention is to provide a method for preventing the collapse of soil about a hole in the ground without having to excavate a large region surrounding the utility apparatus at issue.

Another object of the present invention is to provide a means and method for accommodating misalignment of utility apparatuses which are to be connected underground.

Another object of the present invention is to provide an excavation shield apparatus having sufficient strength to endure forces imposed by soil within a hole.

Other objects, features, and advantages of the present invention will become apparent to one of skill in the art upon examination of the following drawings and detailed description.

BRIEF DESCRIPTION OF THE DRAWINGS

The present invention can be better understood with 35 reference to the following drawings. The drawings are not necessarily to scale, emphasis instead being placed upon clearly illustrating principles of the present invention.

DETAILED DESCRIPTION OF THE PREFERRED EMBODIMENT

Figure 1:
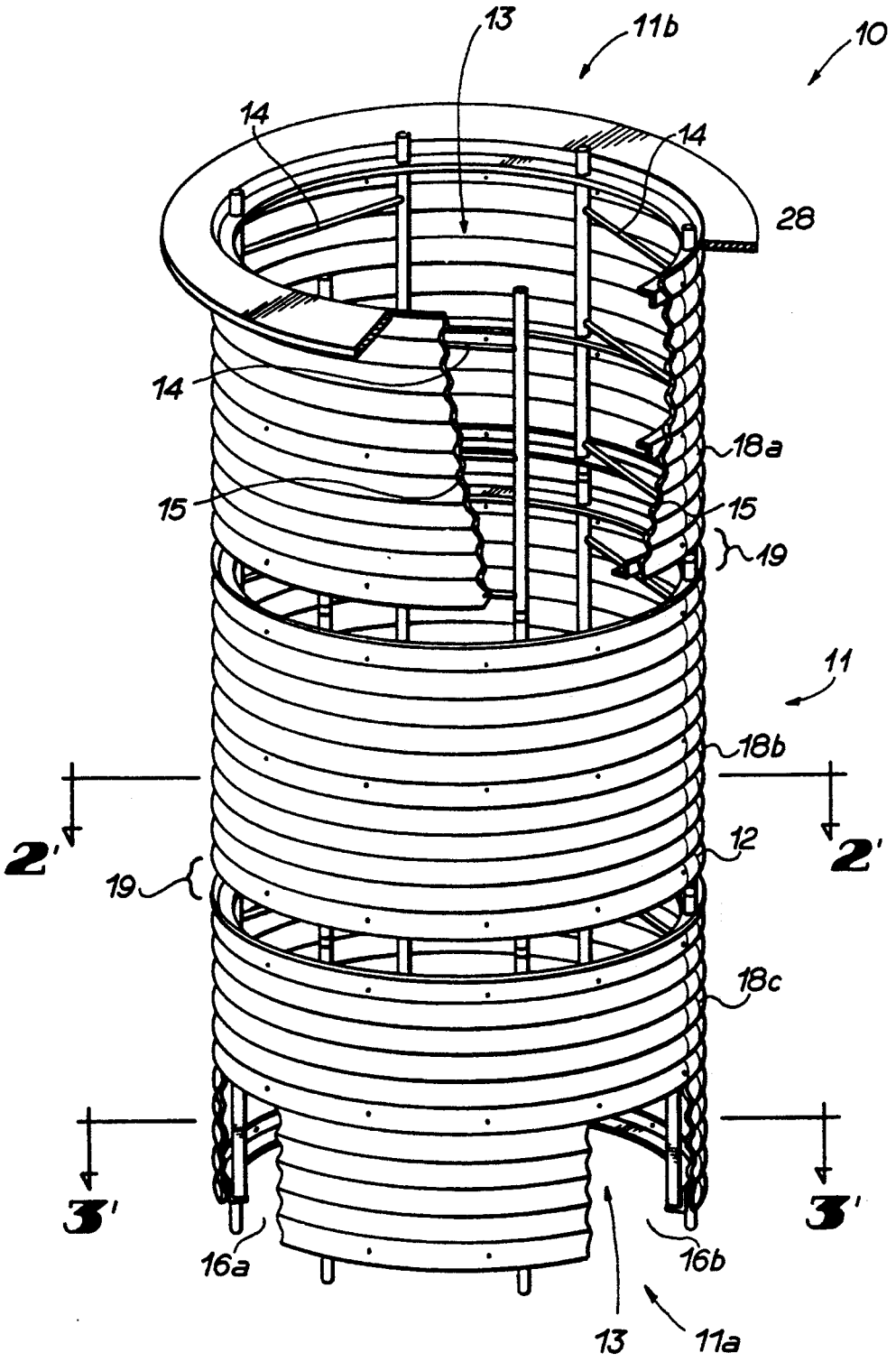
FIG. 1 is a perspective view with partial cutaway section of the novel excavation shield apparatus of the present invention.

With reference now to the drawings wherein like reference numerals designate corresponding parts throughout the several views, a novel excavation shield apparatus 10 in accordance with the present invention is illustrated in FIG. 1. The excavation shield apparatus 10 is assembled and then positioned within a hole in the ground having one or more utility apparatus for preventing the collapse of soil about the hole periphery onto a person within the excavation shield apparatus 10. In the context of this document, "soil" is to be interpreted broadly to include any subsurface ground materials, including gravel, rock, clay, sand, etc.

Figure 2:
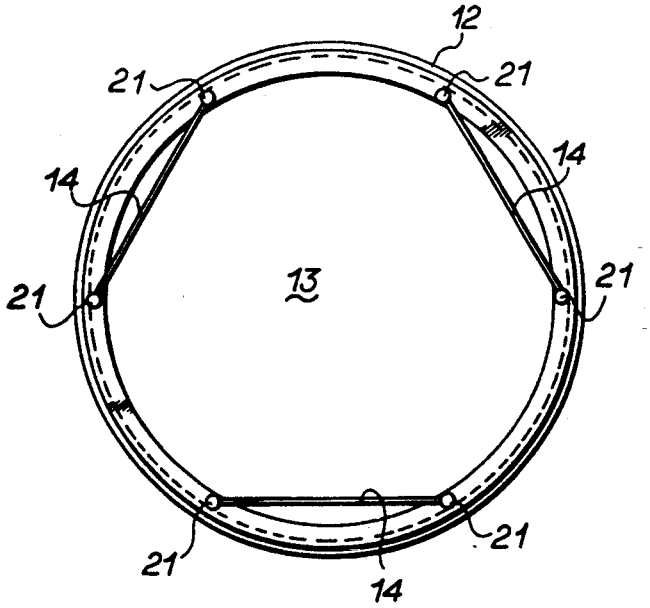
FIG. 2 is a cross-sectional view of the excavation shield apparatus of FIG. 1 taken along line 2'—2'.

The excavation shield apparatus 10 comprises an elongated longitudinal body 11 having a bottom end 11*a* and a top end 11*b*. The longitudinal body 11 has a lateral perimeter wall 12 surrounding a longitudinal throughway 13. The longitudinal body 11 is adapted to be placed substantially vertically within a hole in the ground so that the bottom end resides below the ground level and the top end 11*b* resides in close proximity to the ground level. The top end 11*b* need not reside exactly at the ground level, but preferably a short distance above the ground level so that surrounding soil does not fall into the longitudinal throughway 13 from the top. Moreover, the longitudinal throughway 13 is of sufficient size to permit passage of a person therethrough via ladders 14, as shown by cutaway section 15 of FIG. 1, and the longitudinal body 11 has sufficient strength to endure forces imposed by the surrounding soil without substantial deformation of the longitudinal body 11. A cross-sectional view of the longitudinal body 11 taken along line 2'—2' (FIG. 1) is shown in FIG. 2 for a clearer understanding of the longitudinal body structure. As illustrated in FIG. 2, the ladders 14 are preferably spaced symmetrically about the center of the lateral perimeter wall 12 for optimal access by a worker.

Figure 3:
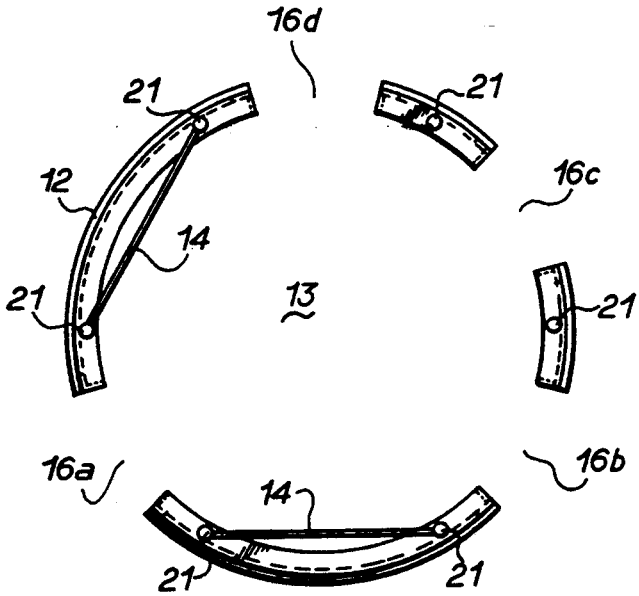
FIG. 3 is a cross-sectional view of the excavation shield apparatus of FIG. 1 taken along line 3'—3'.

One or more apertures 16*a*–16*d*, as illustrated in FIGS. 1 and 3, are located in the lateral perimeter wall 12 at approximately the bottom end 11*a* of the longitudinal body 11 for the purpose of receiving utility apparatus (not shown) therethrough. FIG. 3 illustrates a cross section of the longitudinal body 11 taken along line 3'—3' of FIG. 1. In the preferred embodiment, apertures 16*a*, 16*b* are spaced apart by 120°; apertures 16*b*, 16*c* are spaced apart by 60°; apertures 16*c*, 16*d* are spaced apart by 60°; and apertures 16*d*, 16*a* are spaced apart by 120°. Obviously, other numbers and spacings of apertures 16 are possible.

The plurality of apertures 16*a*–16*d* are a significant beneficial feature of the present invention. They accommodate for misaligned utility apparatus which are to be connected. For instance, if a city sewer line has a branch opening situated at the aperture 16*a*, then a residential sewer branch opening may be channeled into the excavation apparatus 10 via any of the apertures 16*b*–16*d*, the apertures 16*b*, 16*d* being misaligned with, or skewed relative to, the aperture 16*a*. If the utility apparatus are aligned, then they can pass into the longitudinal throughway 13 via the aligned apertures 16*a*, 16*c*. Furthermore, it should be noted that the plurality 16 of apertures 16*a*–16*d* is extremely beneficial in those situations where a structure blocks or partially obstructs one or more of the apertures 16*a*–16*d*. The other remaining unobstructed apertures provide a plurality of other feasible pathways into the longitudinal throughway 13.

Preferably, the longitudinal body 11 comprises a plurality of cylindrical sections 18*a*–18*c* which are adapted to be connected together to form the longitudinal body 11. The plurality of cylindrical sections 18*a*–18*c* are durable and are capable of quick and easy assembly and disassembly for convenient storage, transportation, and repeated use. Other geometric cross sections for the longitudinal body 11, aside from the circular cross section as shown in FIGS. 1–3, are envisioned and are possible, but a circular cross section or polygonal cross section are preferred in that these configurations enable use of construction materials having modest strength, while providing sufficient strength to endure strong forces imposed by the soil upon the exterior of the longitudinal body 11.

In the preferred embodiment, the plurality of cylindrical sections 18*a*–18*c* are spaced apart by gaps 19. Although not required, these gaps 19 provide for air ventilation within the throughway 13 and make the sections 18*a*–18*c* easy to put together and separate.

Figure 4:
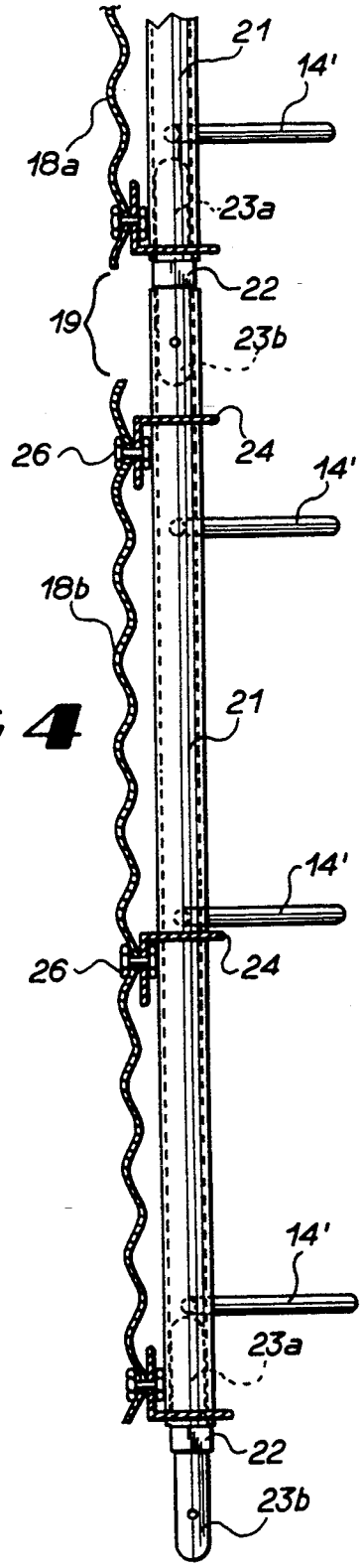
FIG. 4 is an exploded partial cross-sectional view of a lateral perimeter wall of the excavation shield apparatus of FIG. 1 showing a first embodiment for securing together a plurality of cylindrical sections.

The cylindrical sections 18*a*–18*c* preferably comprise a lateral wall 12 formed from a corrugated metal, such a steel or aluminum, as illustrated in FIGS. 1 and 4. Corrugated metal provides adequate strength and durability for the desired implementation as described herein. However, it should be noted that other material types and configurations may be utilized, such as merely a continuous material piece of metal, plastic, fiberglass, or nylon material, or hybrid materials thereof.

A plurality of elongated cylindrical tube frames 21 are associated longitudinally with each of the cylindrical sections 18*a*–18*c*. A side view of a tube frame 21 is shown in FIG. 4. The tube frames 21 are preferably spaced symmetrically about the center of the cylindrical sections 18*a*–18*c*. Further, the tube frames 21 are capable of alignment with adjacent tube frames of adjacent cylindrical sections 18*a*–18*c*. In essence, the arrangement of the tube frames 21 provides a strong internal infrastructure for the apparatus 10.

The plurality of cylindrical sections 18*a*–18*c* may be secured together via any suitable mechanism and technique. In a first embodiment, adjacent tube frames 21 of adjacent cylindrical sections 18*a*–18*c* are coupled together via coupling pins 22 having ends 23*a*, 23*b* for insertion within the hollow interior of tube frames 21, as illustrated in FIG. 4. The cylindrical sections 18*a*–18*c* may be secured to the tube frames 21 by welding, bonding, or some other suitable means, but preferably via a plurality of angle brackets 24 in conjunction with nut and bolt fastening mechanisms 26, the spacing and distribution of which depends in large part upon the strength of materials utilized. In addition, to further simplify the design of the excavation shield apparatus 10, rungs 14' of the ladders 14 may be supported at their ends by affixing them to the spaced tube frames 21. Preferably, the rungs 14' protrude through an orifice within the lateral wall of the tube frames 21 in order to establish a fixed supporting relationship.

Figure 5:
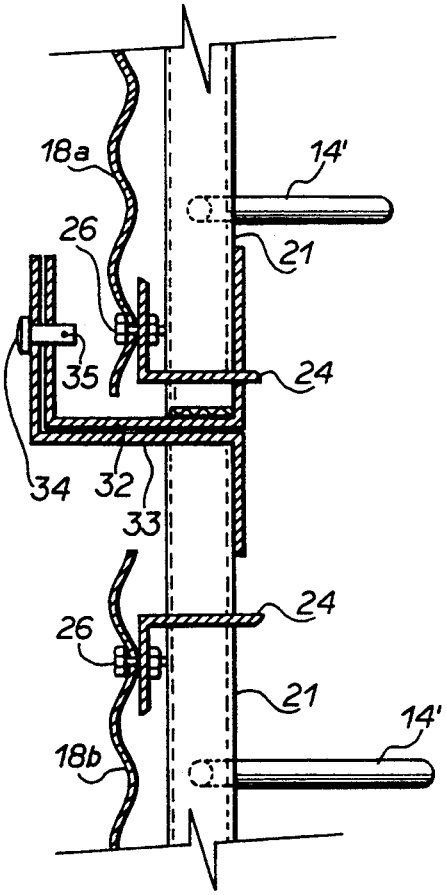
FIG. 5 is an exploded partial cross-sectional view of a lateral perimeter wall of the excavation shield apparatus of FIG. 1 showing a second embodiment for securing together a plurality of cylindrical sections.

As illustrated in FIG. 5, a second embodiment for securing the plurality of cylindrical sections 18*a*–18*c* together involves disposing a mating arrangement of angle bars 32, 33 at each position where tube frames 21 of adjacent cylindrical sections 18*a*–18*c* meet in aligning relation. The angle bars 32, 33 may be secured to the tube frames 21 by welding, bonding, or some other suitable means. The angle bars 32, 33 can be secured together via any number of conventional fastening mechanisms. For instance, as shown, the angle bars 32, 33 may be secured together at the exterior of the apparatus 10 via an elongated pin 34 passing through aligned apertures within the angle bars 32, 33 and having a pin hole 35 at its distal end for receiving a removable clip (not shown) or the like. Other examples of fastening mechanisms include a nut-and-bolt arrangement, and a bolt arrangement which has a single bolt passing into threaded and aligned apertures within the angle bars 32, 33.

Figure 6:
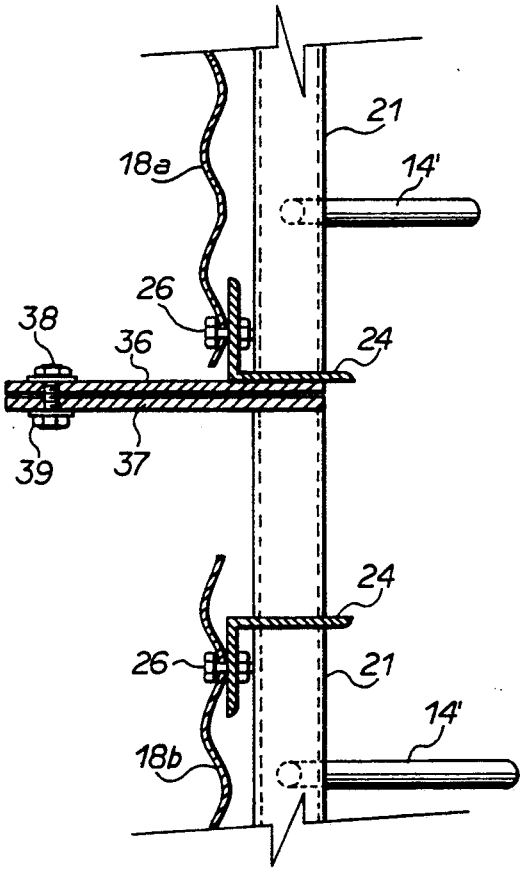
FIG. 6 is an exploded partial cross-sectional view of a lateral perimeter wall of the excavation shield apparatus of FIG. 1 showing a third embodiment for securing together a plurality of cylindrical sections.

As illustrated in FIG. 6, a third embodiment for securing the plurality of cylindrical sections 18*a*–18*c* together involves disposing a mating arrangement of flat plates 36, 37 on adjacent cylindrical sections 18*a*–18*c*. The flat plates 36, 37 may be in the form of flange-like plates running around the full circumference of the apparatus 10. Alternatively, the flat plates 36, 37 may be in the form of a plurality of spaced plates situated at each position where tube frames 21 of adjacent cylindrical sections 18*a*–18*c* meet in aligning relation. The flat plates 36, 37 may be secured to the tube frames 21 and/or angle brackets 24 by welding, bonding, or some other suitable means. The flat plates 36, 37 can be secured together via any number of conventional fastening mechanisms. For instance, as shown in FIG. 6, the flat plates 36, 37 may be secured together at the exterior of the apparatus 10 via a nut-and-bolt arrangement, i.e., a bolt 38 passing through plates 36, 37 and secured by a nut 39. Other examples of fastening mechanisms include a bolt arrangement which has a single bolt passing into threaded and aligned apertures within the flat plates 38, 39, and an elongated pin having a pin hole at its distal end for receiving a removable clip or the like, similar to that shown in FIG. 5.

In accordance with another safety feature of the excavation shield apparatus 10, a planar platform flange 28, as shown in FIG. 1, is situated at the top end 11*b* of the longitudinal body 11. When the excavation shield apparatus 10 is placed within a hole, the platform flange 28 is situated in close proximity to the ground level and essentially bridges the gap between the longitudinal body 11 and the surrounding soil of the hole. Thus, a person intending to ingress or egress from the longitudinal throughway 13 can step onto the flange 28 without potential injury. Preferably, the flange 28 is welded, bonded, bolted, or otherwise affixed to the cylindrical section 18*a*.

It will be obvious to those skilled in the art that many variations and modifications may be made to the preferred embodiment described above without substantially departing from the principles of the present invention. Accordingly, all such variations and modifications are intended to be included herein within the scope of the present invention, as set forth in the following claims.

Wherefore, the following is claimed:

1. An excavation shield apparatus for preventing the collapse of soil about a hole in the ground having a utility apparatus, comprising:

a longitudinal body having a lateral perimeter wall surrounding a longitudinal throughway and having a bottom end and a top end, said longitudinal body comprising a plurality of cylindrical sections which are adapted to be connected together to form an elongated cylindrical body, said longitudinal body adapted to be placed substantially vertically within said hole so that said bottom end resides below the ground level and said top end resides in close proximity to said ground level, said longitudinal throughway being of sufficient size to permit passage of a person therethrough, said longitudinal body having sufficient strength to endure forces imposed by said soil without substantial deformation; and an aperture situated in said lateral perimeter wall approximately at said bottom end, said aperture for receiving said utility apparatus therethrough;

whereby, upon placement of said excavation shield apparatus within said hole, said person may travel through said longitudinal body along said longitudinal throughway to access said utility apparatus while being protected from collapse of said soil by said longitudinal body.

2. The apparatus of claim 1, further comprising two misaligned apertures situated approximately at said bottom end.

3. The apparatus of claim 1, further comprising a flange projecting outwardly about said top end of said longitudinal body.

4. The apparatus of claim 1, further comprising a plurality of elongated frames associated longitudinally with each of said cylindrical sections, said frames being spaced about the periphery of each of said sections and capable of alignment with adjacent frames of adjacent sections, and further comprising a means for detachably coupling said frames of said adjacent cylindrical sections.

5. The apparatus of claim 1, wherein said cylindrical sections each comprise corrugated metal.

6. The apparatus of claim 1, further comprising a ladder affixed to said longitudinal body and extending along said longitudinal throughway.

7. The apparatus of claim 6, further comprising first, second, third, and fourth apertures situated around the periphery of said bottom end, said first and second apertures being spaced 180 degrees apart, said third and fourth apertures being spaced approximately 60 degrees from said second aperture.

8. An excavation shield structure, comprising:

a hole in the ground having a utility apparatus;

a longitudinal body having a lateral perimeter wall surrounding a longitudinal throughway and having a bottom end and a top end, said longitudinal body positioned within said hole so that said bottom end resides below the ground level and said top end resides in close proximity to said ground level, said longitudinal throughway being of sufficient size to permit passage of a person therethrough, said longitudinal body having sufficient strength to endure forces from said soil without substantial deformation; and a plurality of misaligned apertures situated in said lateral perimeter wall approximately at said bottom end, said aperture having said utility apparatus passing therethrough;

whereby said person may travel through said longitudinal body along said longitudinal throughway to access said utility apparatus while being protected from collapse of soil by said longitudinal body.

9. The structure of claim 8, wherein said longitudinal body comprises a plurality of cylindrical sections which are connected together to form an elongated cylindrical body.

10. The structure of claim 8, further comprising a flange situated about said top end of said longitudinal body.

11. The structure of claim 8, further comprising a ladder affixed to said longitudinal body and extending along said longitudinal throughway.

12. The structure of claim 9, further comprising a plurality of elongated frames associated longitudinally with each of said cylindrical sections, said frames being spaced about the periphery of each of said sections and aligned with adjacent frames of adjacent sections, and further comprising a means for detachably coupling said adjacent frames of said adjacent cylindrical sections.

13. The structure of claim 9, wherein said cylindrical sections each comprise corrugated metal.

14. A method for protecting a worker from a collapse of soil within a hole in the ground, the hole having a utility apparatus, comprising the steps of:

assembling an elongated longitudinal body having a lateral perimeter wall surrounding a longitudinal throughway and having a bottom end and a top end, said longitudinal body comprising a plurality of cylindrical sections connected together, said longitudinal body having an aperture situated in said lateral perimeter wall for receiving said utility apparatus, said longitudinal throughway being of sufficient size to permit passage of a person therethrough, said longitudinal body having sufficient strength to endure forces from said soil without substantial deformation;

after assembly, disposing said longitudinal body within said hole so that said top end is over said bottom end; and positioning said longitudinal body so that said bottom end resides below the ground level and said utility apparatus passes through said aperture and into said longitudinal throughway.

15. The method of claim 14, further comprising the step of travelling into said top end and through said longitudinal body along said longitudinal throughway to access said utility apparatus.

16. An excavation shield apparatus for preventing the collapse of soil about a hole in the ground having a utility apparatus, comprising:

a longitudinal body having a lateral perimeter wall surrounding a longitudinal throughway and having a bottom end and a top end, said longitudinal body comprising a plurality of cylindrical sections which are adapted to be connected together to form an elongated cylindrical body, said longitudinal body adapted to be placed substantially vertically within said hole so that said bottom end resides below the ground level and said top end resides in close proximity to said ground level, said longitudinal throughway being of sufficient size to permit passage of a person therethrough, said longitudinal body having sufficient strength to endure forces imposed by said soil without substantial deformation;

a plurality of elongated frames associated longitudinally with each of said cylindrical sections, said frames being spaced about the periphery of each of said sections and capable of alignment with adjacent frames of adjacent sections;

a means for detachably coupling said frames of said adjacent cylindrical sections;

an aperture situated in said lateral perimeter wall approximately at said bottom end, said aperture for receiving said utility apparatus therethrough;

whereby, upon placement of said excavation shield apparatus within said hole, said person may travel through said longitudinal body along said longitudinal throughway to access said utility apparatus while being protected from collapse of said soil by said longitudinal body.

17. The apparatus of claim 16, further comprising at least two misaligned apertures situated approximately at said bottom end.

18. The apparatus of claim 16, further comprising a flange projecting outwardly about said top end of said longitudinal body.

19. The apparatus of claim 16, wherein said cylindrical sections each comprise corrugated metal.

20. The apparatus of claim 16, further comprising a ladder affixed to said longitudinal body and extending along said longitudinal throughway.

21. The apparatus of claim 16, further comprising first, second, third, and fourth apertures situated around the periphery of said bottom end, said first and second apertures being spaced 180 degrees apart, said third and fourth apertures being spaced approximately 60 degrees from said second aperture.

22. An excavation shield structure, comprising:

a hole in the ground having a utility apparatus;

a longitudinal body having a lateral perimeter wall surrounding a longitudinal throughway and having a bottom end and a top end, said longitudinal body comprising a plurality of cylindrical sections which are connected together to form an elongated cylindrical body, said longitudinal body positioned within said hole so that said bottom end resides below the ground level and said top end resides in close proximity to said ground level, said longitudinal throughway being of sufficient size to permit passage of a person therethrough, said longitudinal body having sufficient strength to endure forces from said soil without substantial deformation; and a plurality of elongated frames associated longitudinally with each of said cylindrical sections, said frames being spaced about the periphery of each of said sections and aligned with adjacent frames of adjacent sections;

a means for detachably coupling said adjacent frames of said adjacent cylindrical sections;

an aperture situated in said lateral perimeter wall approximately at said bottom end, said aperture having said utility apparatus passing therethrough;

whereby said person may travel through said longitudinal body along said longitudinal throughway to access said utility apparatus while being protected from collapse of soil by said longitudinal body.

23. The structure of claim 22, further comprising at least two misaligned apertures situated approximately at said bottom end.

24. The structure of claim 22, further comprising a flange situated about said top end of said longitudinal body.

25. The structure of claim 22, further comprising a ladder affixed to said longitudinal body and extending along said longitudinal throughway.

26. The structure of claim 22, wherein said cylindrical sections each comprise corrugated metal.

* * * * *